US011118834B2

(12) United States Patent
Goloubev

(10) Patent No.: US 11,118,834 B2
(45) Date of Patent: Sep. 14, 2021

(54) METHOD AND DEVICE FOR GENERATING GASEOUS COMPRESSED NITROGEN

(71) Applicant: LINDE AKTIENGESELLSCHAFT, Munich (DE)

(72) Inventor: Dimitri Goloubev, Munich (DE)

(73) Assignee: LINDE AKTIENGESELLSCHAFT, Munich (DE)

( * ) Notice: Subject to any disclaimer, the term of this patent is extended or adjusted under 35 U.S.C. 154(b) by 1166 days.

(21) Appl. No.: 14/769,465

(22) PCT Filed: Mar. 18, 2014

(86) PCT No.: PCT/EP2014/000723
§ 371 (c)(1),
(2) Date: Aug. 21, 2015

(87) PCT Pub. No.: WO2014/146779
PCT Pub. Date: Sep. 25, 2014

(65) Prior Publication Data

US 2016/0003531 A1 Jan. 7, 2016

(30) Foreign Application Priority Data

Mar. 19, 2013 (EP) ..... 13001416

(51) Int. Cl.
*F25J 3/04* (2006.01)
*F25J 3/02* (2006.01)
*F25J 3/08* (2006.01)

(52) U.S. Cl.
CPC ..... *F25J 3/0257* (2013.01); *F25J 3/044* (2013.01); *F25J 3/0409* (2013.01);
(Continued)

(58) Field of Classification Search
CPC .. F25J 3/04303; F25J 3/04296; F25J 2200/54; F25J 3/04703; F25J 2250/20;
(Continued)

(56) References Cited

U.S. PATENT DOCUMENTS

2011/0023540 A1* 2/2011 Alekseev ..... F25J 3/04084 62/643

FOREIGN PATENT DOCUMENTS

EP 1308680 A1 * 5/2003 ..... F25J 3/04375
FR 2973485 A1 * 10/2012 ..... F25J 3/04054

OTHER PUBLICATIONS

Translation of FR 2973485.*

* cited by examiner

*Primary Examiner* — John F Pettitt, III
(74) *Attorney, Agent, or Firm* — Millen, White, Zelano & Branig; Brion P. Heaney

(57) ABSTRACT

Method and device for generating gaseous compressed nitrogen by the low-temperature separation of air in a distillation column system, having a pre-column, a high-pressure column and a low-pressure column. The feed air is compressed, purified in a purification apparatus and cooled. A first sub-flow of the cooled feed air is introduced in a predominantly liquid state into the distillation column system. A gaseous fraction from the pre-column in introduced into the liquefaction chamber of a pre-column head condenser with liquid formed therein fed as reflux into the pre-column. A first gaseous nitrogen product fraction is drawn from the high-pressure column, heated, and obtained as first gaseous compressed nitrogen product. At least a part of the second sub-flow is introduced into the evaporation chamber of the pre-column head condenser. A third sub-flow
(Continued)

Figure 1:
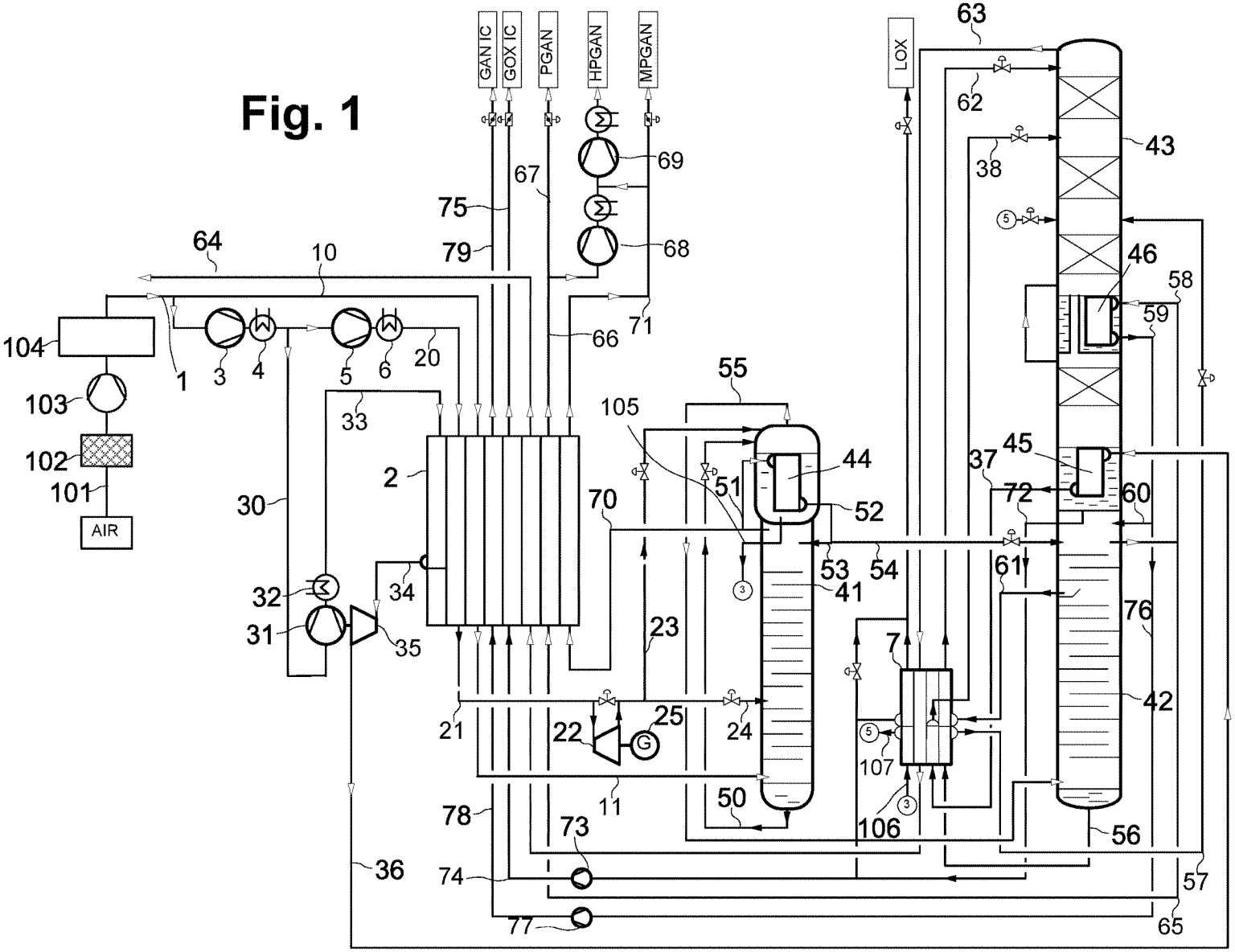

of the cooled feed air is expanded to perform work and subsequently introduced into the liquefaction chamber.

17 Claims, 5 Drawing Sheets

(52) U.S. Cl.
CPC ..... *F25J 3/04054* (2013.01); *F25J 3/04084* (2013.01); *F25J 3/0486* (2013.01); *F25J 3/04175* (2013.01); *F25J 3/04296* (2013.01); *F25J 3/04303* (2013.01); *F25J 3/04387* (2013.01); *F25J 3/04393* (2013.01); *F25J 3/04442* (2013.01); *F25J 3/04915* (2013.01); *F25J 3/08* (2013.01); *F25J 2200/54* (2013.01); *F25J 2240/10* (2013.01); *F25J 2250/02* (2013.01); *F25J 2250/04* (2013.01); *F25J 2290/12* (2013.01)

(58) Field of Classification Search
CPC .. F25J 3/04915; F25J 3/04387; F25J 3/04442; F25J 3/04084; F25J 3/0409; F25J 3/04054; F25J 3/04175; F25J 3/0486
See application file for complete search history.

METHOD AND DEVICE FOR GENERATING GASEOUS COMPRESSED NITROGEN

The invention relates to a method for generating gaseous compressed nitrogen by low-temperature separation of air in a distillation column system. Such systems typically include a pre-column, a high-pressure column and a low-pressure column along with a main air compressor to compress all the input air. Also included is a cleaning device for cleaning the compressed input air, and a main heat exchanger for cooling the cleaned input air. In these systems, a first partial current of the cooled input air is fed in gaseous form info the pre-column and a second partial current of the cooled input aft is fed in a predominantly liquid state into the distillation column system. The pre-column has a pre-column head condenser that takes the form of a condenser/evaporator having a liquefaction chamber and an evaporation chamber. A gaseous fraction from the upper region of the pre-column is fed into the liquefaction chamber of the head condenser and least part of the liquid that is formed in the liquefaction chamber is returned to the pre-column. The low-pressure column has a low-pressure column sump evaporator that takes the form of a condenser/evaportaor having a liquefaction chamber and an evaporation chamber. A first nitrogen product fraction is drawn off from the high-pressure column in gaseous form, is warmed in the main heat exchanger and is obtained as a first gaseous compressed nitrogen product. At least a first part of the second partial current is fed into the evaporation clamber of the pre-column head condenser and the pressure of a third partial current of the cooled input air is let down such that work is preformed. The pressure of the third partial current s higher at exit from letting down the pressure such that work is performed than the operating pressure of the low-pressure column.

Methods and devices for low-temperature separation of air are known for example from Hausen/Linde, Tiefiemperaturtechnik [Low-Temperature Engineering], $2^{nd}$ edition 1985, Chapter 4 (pages 281 to 337).

The distillation column system of the invention includes a three-column system having a pre-column, a high-pressure column and a low-pressure column. The last two of these are conventionally in a heat-exchange relationship by way of at least one condenser/evaporator. The pre-column has a higher operating pressure than the high-pressure column. In addition to the columns for nitrogen/oxygen separation, the distillation column system may have further devices, for example for obtaining other air components, in particular inert gases, for example for obtaining argon, which includes at least one raw argon column, or for obtaining krypton/xenon. Besides the distillation columns, the distillation column system also includes the heat exchangers directly associated with them, these heat exchangers typically taking the form of condenser/evaporators.

A "main heat exchanger" serves to cool input air in an indirect heat exchange with countercurrents from the distillation column system. It may be formed by a single or a plurality of heat exchanger sections that are connected in parallel and/or in series, for example comprising one or more plate heat exchanger blocks.

The term "condenser/evaporator" designates a heat exchanger in which a first, condensing fluid current comes into indirect heat exchange with a second, evaporating fluid current. Each condenser/evaporator has a liquefaction chamber and an evaporation chamber which comprise liquefaction passages and evaporation passages respectively. In the liquefaction chamber, condensation (liquefaction) of the first fluid current is carried out, and in the evaporation chamber evaporation of the second fluid current. The evaporation and liquefaction chambers are formed by groups of passages that are in a heat-exchange relationship with one another.

The evaporation chamber of a condenser/evaporator may take the form of a bath evaporator, falling-film evaporator or forced-flow evaporator.

A current that is in a "predominantly liquid state" is one whereof the liquid portion is at least 50 mol %, in particular at least 70 mol %.

A "low-pressure column sump evaporator" may be arranged directly in the sump of the low-pressure column or, as an alternative, in a container that is separated from the low-pressure column. In either case, its evaporation chamber and the sump chamber of the low-pressure column are in communication and in particular are at substantially the same pressure.

A method of the type mentioned at the outset and a corresponding device are known from US 2011023540 A1 (=WO 2009095188 A2), This method refers chiefly to obtaining large quantities of oxygen at very high pressure, significantly above 6 bar, by internal compression. Although compressed nitrogen is obtained directly from the distillation column system in this case too, this is only possible to a comparatively small extent. The compressed nitrogen product is in this case predominantly also obtained by internal compression, by removing nitrogen from the distillation column system in liquid form (namely from the liquefaction chamber of the high-pressure column head condenser), bringing it to an elevated pressure in the liquid state and evaporating it or, if the pressure is supercritical, pseudo-evaporating it in the main heat exchanger. Although this does allow considerable quantities of compressed nitrogen to be obtained, the energy efficiency is not always satisfactory.

Within the context of the invention, a method is sought that is able to generate particularly large quantities of compressed nitrogen and to operate particularly efficiently with a moderate expense for apparatus.

This object is achieved according to the invention wherein the third partial current that is let down such that work is performed is fed into the liquefaction chamber of the low-pressure column sump evaporator and is at least partly liquefied there and at least part of the liquefied third partial current is fed into the low-pressure column. In addition, the low-pressure column has an intermediate evaporator that takes the form of a condenser/evaporator having a liquefaction chamber and an evaporation chamber. At least part of an intermediate liquid of the low-pressure column is evaporated in the evaporation chamber of the intermediate evaporator, and at least part of a gaseous head fraction from the high-pressure column is liquefied in the liquefaction chamber of the intermediate evaporator, with at least part of the liquid obtained in this way being returned to the high-pressure column. According to the invention more than 35 mol %, in particular more than 45 mol % of the input air quantity, in the form of the first nitrogen product fraction, which is drawn off in gaseous form from the high-pressure column, is warmed in the main heat exchanger and is obtained as a first gaseous compressed nitrogen product.

Within the context of the invention, it has surprisingly been found that a method having a pre-column is not only suitable for liquid production and for oxygen internal compression but, in conjunction with the other features of the claim, is also suitable for obtaining large quantities of compressed nitrogen directly from the high-pressure column. Although, in the method according to the invention, one or more compressed nitrogen product currents are obtained, for example by internal compression or by removing gas from the pre-column, the total quantity thereof is in all cases smaller than in the first nitrogen product fraction, and is for example less than 20 mol % of the input air quantity, in particular less than 10 mol % of the input air quantity.

Baking out in the low-pressure column with a turbine air current (the "third partial current" whereof the pressure is let down such that work is performed) enables the pressure in the high-pressure column to be comparatively low and hence the system to be operated particularly efficiently. The operating pressure of the high-pressure column need only be high enough for the head nitrogen of the high-pressure column to condense in the intermediate evaporator of the low-pressure column. At the same time, the expense for apparatus in the form of a complicated intermediate removal at an air compressor is avoided, in that adjustment to the required pressure is carried out by means of the letting down of pressure such that work is performed.

In cooperation with the pre-column, this condenser configuration results in a further energy saving which proves to be surprisingly high. Although it is known per sc from FR 2973485 A1 for a two-column system, hitherto a combination with a three-column system has not been proposed, since no particular advantage was to be expected therefrom.

The "intermediate evaporator" may be arranged in the interior of the low-pressure column or, as an alternative, in a container that is separated from the low-pressure column. In its evaporation chamber, at least part of an intermediate liquid of the low-pressure column is evaporated. The intermediate fraction that is evaporated here is fed back into the low-pressure column again, and there serves as rising gas.

Within the context of a preferred embodiment of the invention, in addition to the compressed nitrogen that is removed directly from the high-pressure column a second gaseous nitrogen product fraction is drawn off from the pre-column in gaseous form, warmed in the main heat exchanger and obtained as a second gaseous compressed product.

In the method according to the invention, preferably less than 30 mol % of the input air quantity is fed in the liquid state into the distillation column system. Nonetheless, the pre-column brings about a marked improvement in the energy efficiency of the method; according to US 2011023540 A1, this could only be expected with a particularly high level of pre-liquefaction of the air.

Here, it is favorable if the total quantity of oxygen-enriched currents that are fed in the liquid state from the pre-column and the evaporation chamber of the pre-column head condenser into the high-pressure column and the low-pressure column is less than 1 mol % of the input air quantity.

The second partial current of the input air serves in particular for obtaining a gaseous compressed product by internal compression characterized in that a second gaseous nitrogen product fraction is drawn off from the pre-column in gaseous form, warmed in the main heat exchanger and obtained as a second gaseous compressed product. Here, for example liquid oxygen from the low-pressure column or a relatively small quantity of liquid nitrogen from the high-pressure column or from the head condenser thereof may be removed, and evaporated (if the pressure is subcritical) or pseudo-evaporated (if the pressure is supercritical) in the main heat exchanger. A combination of a plurality of internal compression products of different compositions and/or different pressures is also possible. Here, the second partial current, which has been brought to a high pressure, is liquefied (if its pressure is subcritical) or pseudo-liquefied (if its pressure is supercritical). Then, pressure is let down in at least some of the second partial current, to the pressure of the evaporation chamber of the pre-column head condenser, Pressure may be let down in a throttle valve and/or in a liquid turbine.

According to a further advantageous embodiment of the method according to the invention, a gaseous fraction from the evaporation chamber of the pre-column head condenser is fed, as a gaseous input current, into the high-pressure column. This fraction in particular represents the single gaseous input current of the high-pressure column.

It is further favorable if at least some of the sump liquid of the pre-column is fed into the evaporation chamber of the pre-column head condenser. Preferably, this procedure is carried out with all the pre-column sump liquid. The combination of sump liquid and second partial current of the input air in particular forms the total input for the evaporation chamber of the pre-column head condenser.

Preferably, the third partial current is post-compressed before being cooled in the main heat exchanger. For this purpose, an externally driven post-compressor and/or turbine-driven post-compressor may be used.

It is moreover favorable if the pressure of the third partial current is lower at the exit from letting down the pressure such that work is performed than the operating pressure of the high-pressure column. The difference between the pressure at the entry to the liquefaction chamber of the low-pressure column sump evaporator and the pressure at the turbine outtake may in this case be relatively small.

The invention further relates to a device for generating gaseous compressed nitrogen by low-temperature separation of air, having a distillation column system including a pre-column a high-pressure column and a low-pressure column, and having a main air compressor for compressing all the input air the input air that is encompassed within a quantity of input air, a cleaning device for cleaning the compressed input air, and a main heat exchanger for cooling the cleaned input air. The device also includes apparatus for feeding a first partial current of the cooled input air in the gaseous state into the pre-column, and apparatus for feeding a second partial current of the cooled input air predominantly liquid state into the distillation column system. The pre-column has a pre-column head condenser that takes the form of a condenser/evaporator having, a liquefaction chamber and an evaporation chamber and includes apparatus for feeding a gaseous fraction from the upper region of the pre-column into the liquefaction chamber of the head condenser, and apparatus for returning liquid that is formed in the liquefaction chamber to the pre-column. The low-pressure column has a low-pressure column sump evaporator that takes the form of a condenser/evaporator having a liquefaction chamber and an evaporation chamber and includes apparatus for drawing off a first nitrogen product fraction from the high-pressure column, for warming the first nitrogen product fraction in the main heat exchanger and for obtaining the warmed first nitrogen product fraction as a first gaseous compressed nitrogen product. The apparatus for drawing off a first nitrogen product fraction from the high-pressure column is constructed for the gaseous removal of the first nitrogen product fraction from the high-pressure column. The device also includes apparatus for feeding at least a first part of the second partial current into the evaporation chamber of the pre-column head condenser, a let down machine for letting down the pressure of a third partial current of the cooled input air such that work is performed, and apparatus for feeding the third partial current that has been let down such that work is preformed into the liquefaction chamber of the low-pressure column sump evaporator. The device of the invention is further characterized by apparatus for feeding the liquefied third partial current from the liquefaction chamber of the low-pressure column sump evaporator into the low-pressure column, and an intermediate evaporator of the low-pressure column that takes the form of a condenser/evaporator having a liquefaction chamber and an evaporation chamber. The device of the invention is also characterized by apparatus for feeding an intermediate liquid of the low-pressure column into the evaporation chamber of the intermediate evaporator, apparatus for feeding a gaseous head fraction from the high-pressure column into the liquefaction chamber of the intermediate evaporator, and apparatus for returning liquid from the liquefaction chamber of the intermediate evaporator to the high-pressure column. In addition the device according to the invention includes a regulating apparatus which is set up to adjust the plant during operation such that more than 30 mol % of the input air quantity, in particular more than 45 mol % of the input air quantity, in the form of the first nitrogen product fraction, which is drawn off in gaseous form from the high-pressure column, is warmed in the main heat exchanger and is obtained as a first gaseous compressed nitrogen product. The device of the invention is also characterize by apparatus for drawing off a second nitrogen product fraction in a gaseous state from the high-pressure column, for warming the second nitrogen product fraction in the main heat exchanger and for obtaining the warmed second nitrogen product fraction as a second gaseous compressed nitrogen product. The regulating apparatus is set up to adjust the plant during operation such that less than 30 mol % of the input air quantity is fed in the liquid state into the distillation column system. The regulating apparatus is also set up to adjust the plant during operation such that the total quantity of oxygen-enriched currents that are fed in the liquid state from, the pre-column and the evaporation chamber of the pre-column head condenser into the high-pressure column and the low-pressure column is less than 14%, in particular less than 1 mol %, of the input air quantity. The device according to the invention may be supplemented by device features including that a second gaseous nitrogen product fraction is drawn off from the pre-column in gaseous form, warmed in the main heat exchanger and obtained as a second gaseous compressed product. Further the device may include the feature that less than 30 mol % of the input air quality is fed in the liquid state into the distillation column system and the total quantity of oxygen-enriched currents that are fed in the liquid state from the pre-column and the evaporation chamber of the pre-column head condenser into the high-pressure column and the low-pressure column is less than 14%, in particular less than 1 mol %, of the input air quality. The device of the invention may also have the feature that the second partial current is compressed before being cooled in the main heat exchanger to a high pressure that is higher than the operating pressure of the pre-column, and is liquefied or pseudo-liquefied in the main heat exchanger, and that a liquid current, in particular a liquid oxygen current, is removed from the distilled column system, brought to an elevated pressure in the liquid state, evaporated or pseudo-evaporated in the main heat exchanger and finally obtained as a gaseous compressed product. The device of the invention may include the feature that a gaseous fraction from the evaporation chamber of the pre-colUmn head condenser is fed, as a gaseous input current, into the high-pressure column, in particular as a single gaseous input current of the high-pressure column, and that at least some of the sump liquid of pre-column is fed into the evaporation chamber of the pre-column head condenser. The device features may include that the third partial current is post compressed before being cooled in the main heat exchanger and that the pressure of the third partial current is lower at the exit from letting down the pressure such that work is performed than the operating pressure of the high-pressure column.

The "regulating apparatus" comprises complex open-loop and closed-loop control devices that, in cooperation, enable the corresponding process parameters to be achieved at least partly automatically, for example by means of a correspondingly programmed operating control system.

The operating pressures in the distillation column system of the invention (in each case at the head) are:

Pre-column: for example 6 to 9 bar, preferably 6 to 7.5 bar

High-pressure column: for example 3 to 6 bar, preferably 3.5 to 4.5 bar

Low-pressure column: for example 1.25 to 1.7 bar, preferably L3 to 1.5 bar

The invention and further details of the invention will be explained in more detail below with reference to exemplary embodiments illustrated schematically in FIGS. 1 to 5.

The system illustrated in FIG. 1 has a distillation column system having a pre-column 41, a high-pressure column 42, a low-pressure column 43, a pre-column head condenser 44, a low-pressure column sump evaporator 45 and a low-pressure column intermediate evaporator 46. The operating pressures, in each case at the head, are:

Pre-column: 7.3 bar

High-pressure column: 4.1 bar

Low-pressure column: 1.37 bar

Compressed, pre-cooled and cleaned input air 1 enters at a pressure of 7.6 bar. The main air compressor 103, which draws atmospheric air in by way of line 101 and a filter 102 and compresses it to the said pressure, and pre-cooling and cleaning of the air (104) are carried out in a known manner and are illustrated only schematically in the drawing.

A "first partial current"10 of input air is cooled in a main heat exchanger 2, approximately to dew point, and enters the pre-column 41 in a gaseous state by way of line 11.

Using external energy, a "second partial current" 20 is post-compressed, approximately to a high-pressure of approximately 70 bar, in two post-compressor stages 3, 5 having aftercoolers 4, 6. (This pressure is very strongly dependent on the desired oxygen product pressure, which in the example is about 50 bar.) The second partial current enters the main heat exchanger 2 at this high pressure and is cooled and pseudo-liquefied there. The second partial current 21 that exits from the main heat exchanger 2 is let down in a liquid turbine 22, such that work is performed, approximately to the operating pressure of the pre-column 41, and a first part 23 thereof is fed into the evaporation chamber of the pre-column head condenser 44. The remainder 24 flows into the pre-column 41. The liquid turbine 22 is braked by a generator 25.

A "third partial current" 30 is branched off upstream of the second post-compressor stage 5 and its pressure is bought to about 16 bar in a turbine-driven post-compressor 31 having an aftercooler 32. It enters the main heat exchanger 2 at the warm end, by way of line 33. It is removed again at an intermediate temperature by way of line 34, and is let down such that work is performed, in an air turbine 35. The third partial current 36 which has been let down such that work was performed is at least partly, preferably entirely or substantially entirely, liquefied in the liquefaction chamber of the low-pressure column sump evaporator 45. The liquefied third partial current 37 is further cooled in a supercooling countercurrent exchanger 7 and fed to an intermediate position in the low-pressure column by way of line 38.

The entirety of the sump liquid 50 of the pm-column is fed into the evaporation chamber of the pm-column head condenser 44. In the liquefaction chamber thereof, a first part 51 of the gaseous head nitrogen of the pre-column is condensed. A first part 53 of the liquid nitrogen 52 that is generated during this is returned to the pre-column 41, and a second part 54 is delivered to the high-pressure column 42. The gaseous fraction 55 that is formed in the evaporation chamber of the pre-column head condenser is fed into the high-pressure column 42 as a gaseous input current. In the exemplary embodiment, it forms in particular the single gaseous input current of the high-pressure column 42. A small liquid flushing current 105/106 is drawn off from the evaporation chamber of the pre-column head condenser 44, continuously or from time to time, and is warmed in the supercooling countercurrent exchanger 7 (the flow of the flushing current from the evaporation chamber of the pre-column head condenser 44 to the supercooling countercurrent exchanger 7 is represented by the symbols ③) and fed into the low-pressure column by way of line 107 the flow from line 107 into the low-pressure column 43 is represented by the symbols ⑤).

Taken as an average over time, this flushing quantity is less than 14 mol %, in particular less than 1 mol %, of the input air quantity.

After being cooled in the supercooling countercurrent exchanger 7, the sump liquid 56/57 of the high-pressure column is fed into the low-pressure column 43. A first part 58 of the gaseous head nitrogen of the high-pressure column is at least partly, preferably entirely or substantially entirely, liquefied in the intermediate evaporator 46 of the low-pressure column 42. A first part 60 of the liquid nitrogen 59 that is generated during this is returned to the high-pressure column 42. After being cooled in the supercooling countercurrent exchanger 7, a nitrogen-rich liquid 61/62 from an intermediate position in the high-pressure column 42 is returned to the head of the low-pressure column 43. Gaseous impure nitrogen 63 from the head of the low-pressure column 43 is warmed, approximately to ambient temperature, in the supercooling countercurrent exchanger 7 and further in the main heat exchanger 2. The warm, unpressurized impure nitrogen 64 may be used as the regeneration gas in the cleaning apparatus (104) for the input air, or be expelled to the atmosphere.

A second part of the gaseous head nitrogen of the high-pressure column 42 forms the "first nitrogen product fraction" 65 and is warmed, approximately to ambient temperature, in the main heat exchanger 2. The warm high-pressure column nitrogen 66 is obtained either directly (by way of line 67) or after further compression in the product compressors 68, 69 as a gaseous compressed nitrogen product (PLAN or HPGAN). In the exemplary embodiment, the quantity of the first nitrogen fraction is approximately 49 mol % of the input air quantity.

A second part of the gaseous head nitrogen of the pre-column 41 forms the "second nitrogen product fraction" 70 and is warmed, approximately to ambient temperature, in the main heat exchanger 2. The warm pre-column nitrogen 71 is obtained either directly (MPGAN) or after further compression in the product compressor 69 (HPGAN) as a gaseous compressed nitrogen product.

Moreover, in the exemplary embodiment two compressed product fractions (GOX IC and GAN IC) are obtained by internal compression.

The quantities of the second nitrogen product fraction and the compressed product fraction that is internally compressed are, in the exemplary embodiment, in each case less than 20 mol % of the input air quantity, in particular less than 10 mol % of the input air quantity.

Liquid oxygen 72 is removed from the low-pressure column 43 (or to be more precise, from the evaporation chamber of the low-pressure column sump evaporator 45), brought to an elevated pressure of 50 bar in a liquid state by means of an oxygen pump 73, guided by way of line 74 to the main heat exchanger 2, pseudo-evaporated and finally obtained as a gaseous compressed product 75.

A second part 76 of the liquid nitrogen 59 from the low-pressure column intermediate evaporator 46 is brought to an elevated pressure in the liquid state by means of a nitrogen pump 77, guided by way of line 78 to the main heat exchanger 2, evaporated or pseudo-evaporated and finally obtained as a gaseous compressed product 79.

In the exemplary embodiment of FIG. 1, the material exchange elements in the pre-column 41 and in the high-pressure column 42 are formed by sieve bases and in the low-pressure column 43 by ordered packing. All three condenser/evaporators 44, 45, 46 take the form of bath evaporators.

As an alternative to this, the material exchange elements in the pre-column 41 and/or in the high-pressure column 42 may also be formed by ordered packing. Similarly, it is possible to equip one of these columns or both columns 41, 42 partly with bases, in particular sieve bases, and partly with ordered packing.

Figure 2:
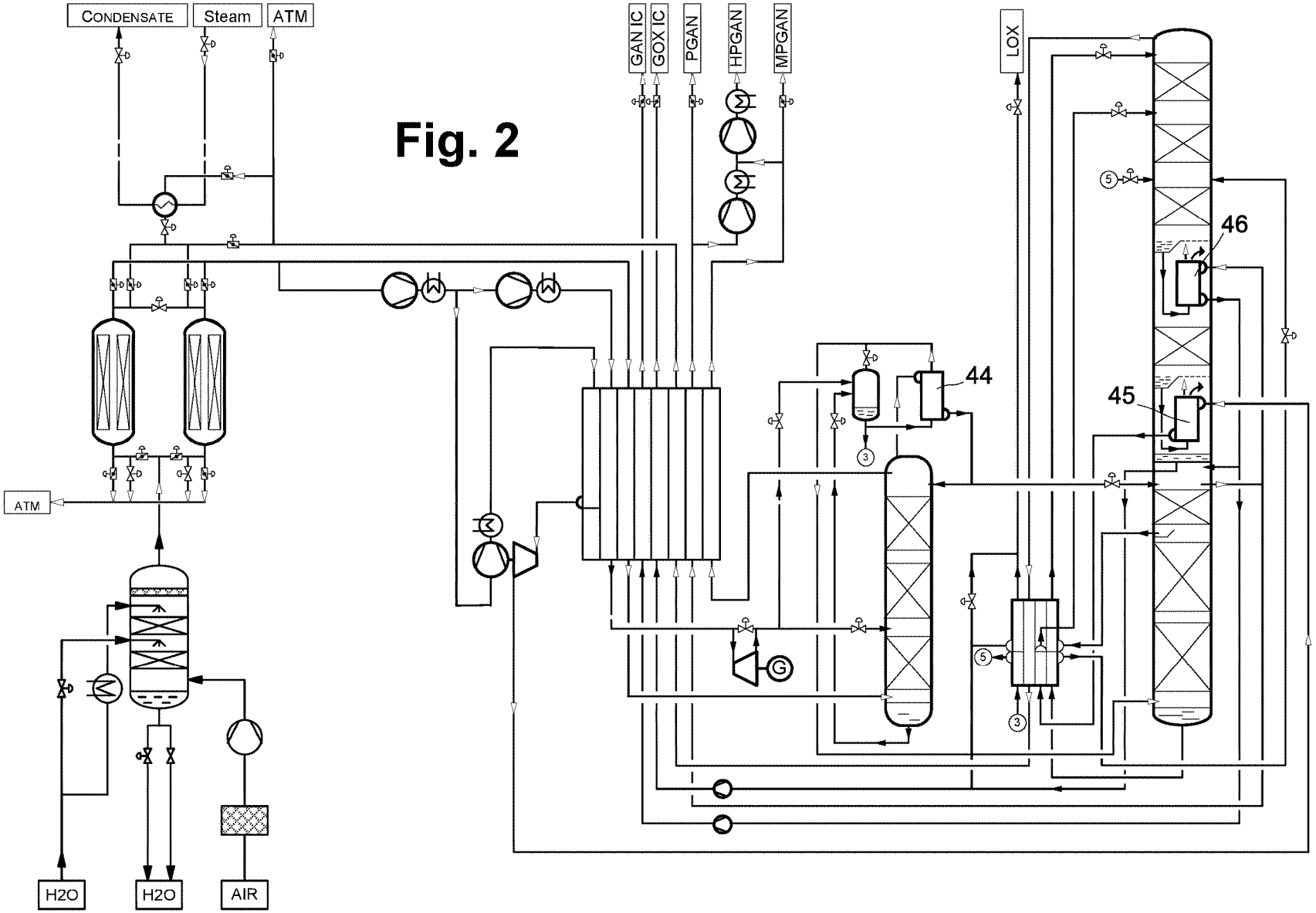

The exemplary embodiment of FIG. 2 corresponds largely to the variant in FIG. 1, with use exclusively of ordered packing in the columns. As a further difference, the three condenser/evaporators 44, 45, 46 take the form of forced-flow evaporators.

Figure 3:
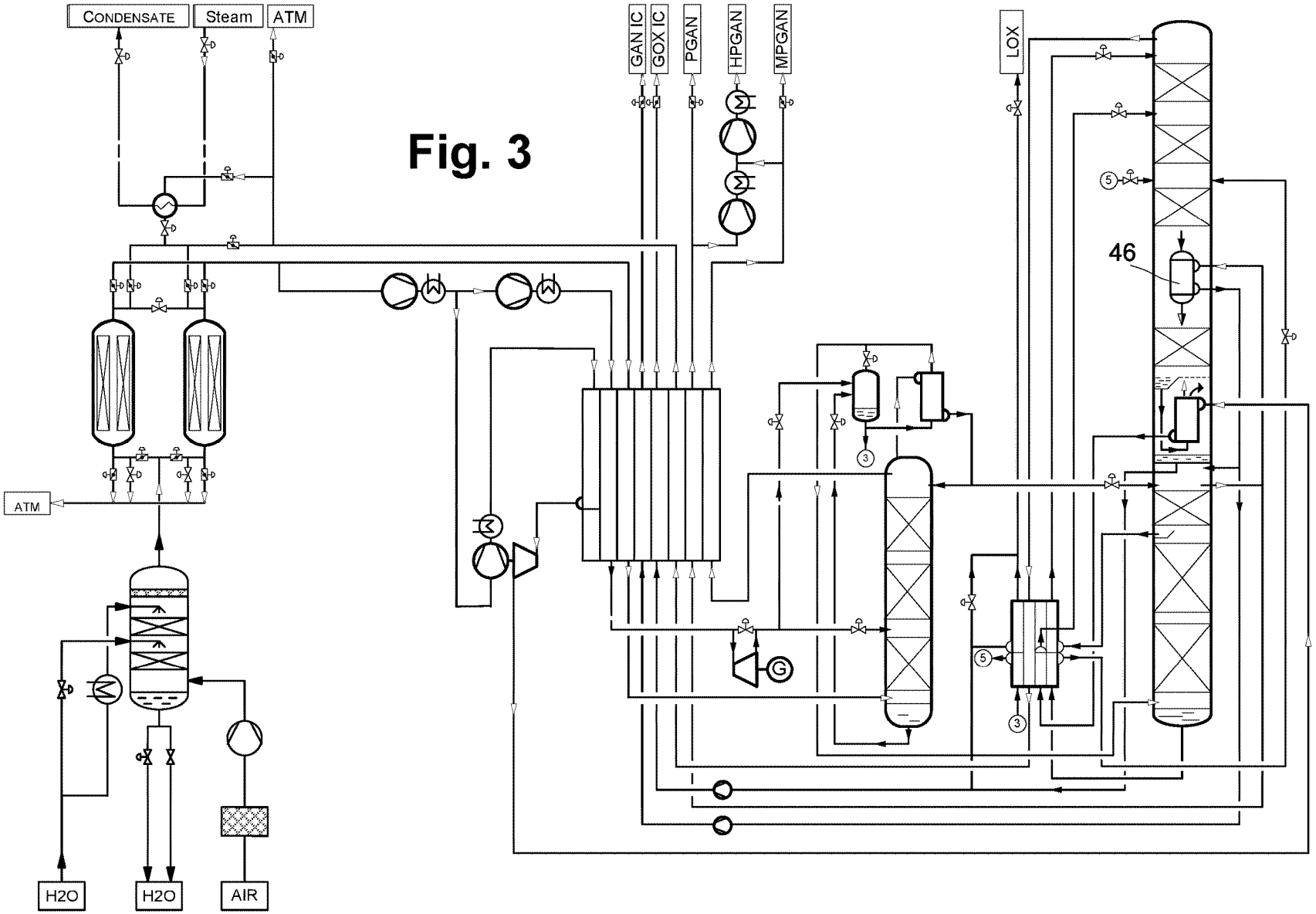

FIG. 3 differs from FIG. 2 in that the low-pressure column intermediate evaporator 46 takes the form of a falling-film evaporator.

Figure 4:
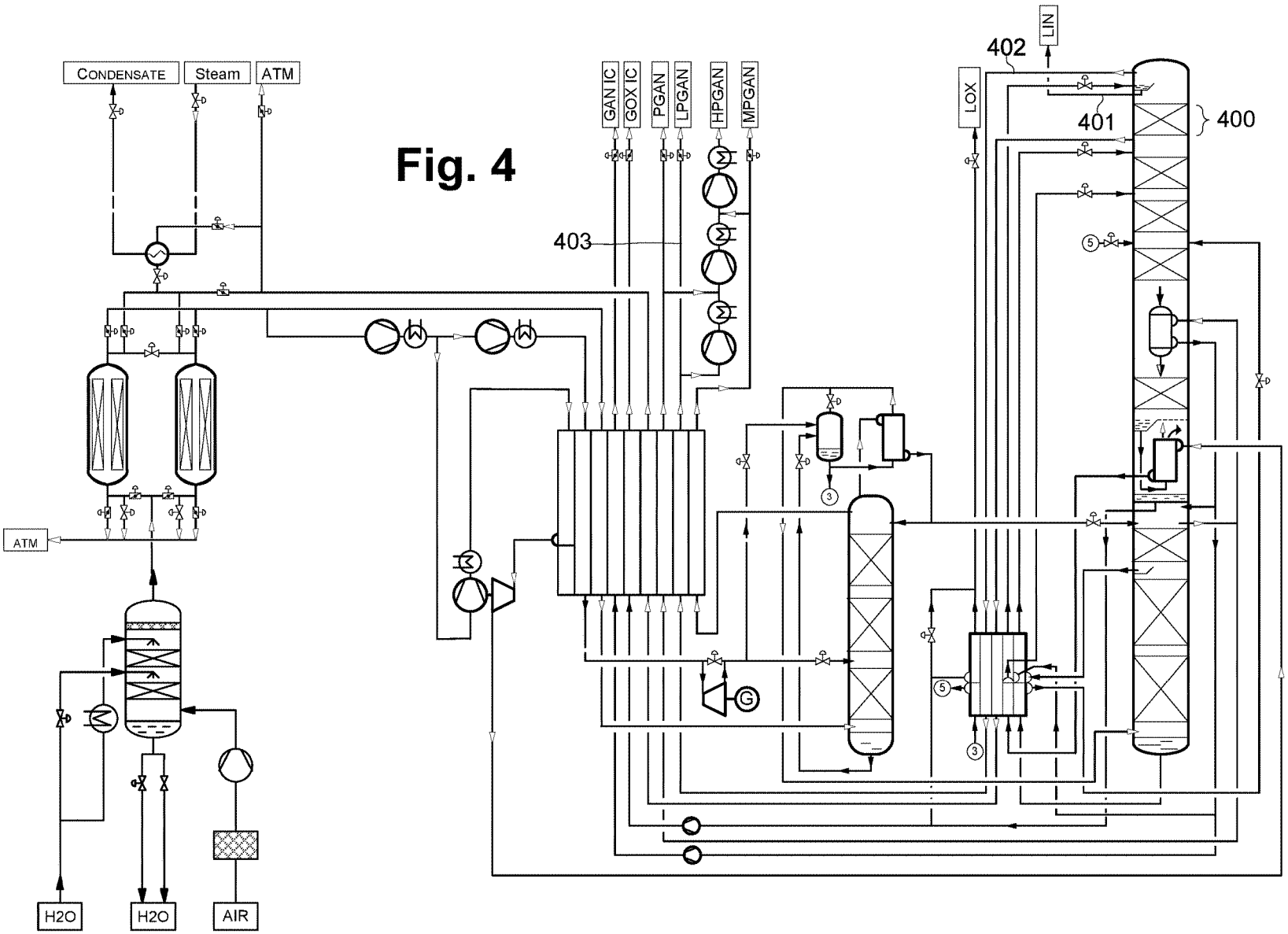

In FIG. 4, the low-pressure column has, in addition to that shown in FIG. 3, a pure nitrogen section 400. This additionally allows liquid nitrogen 401 (LIN) and pure low-pressure nitrogen 402/403/LPGAN to be obtained as products.

Figure 5:
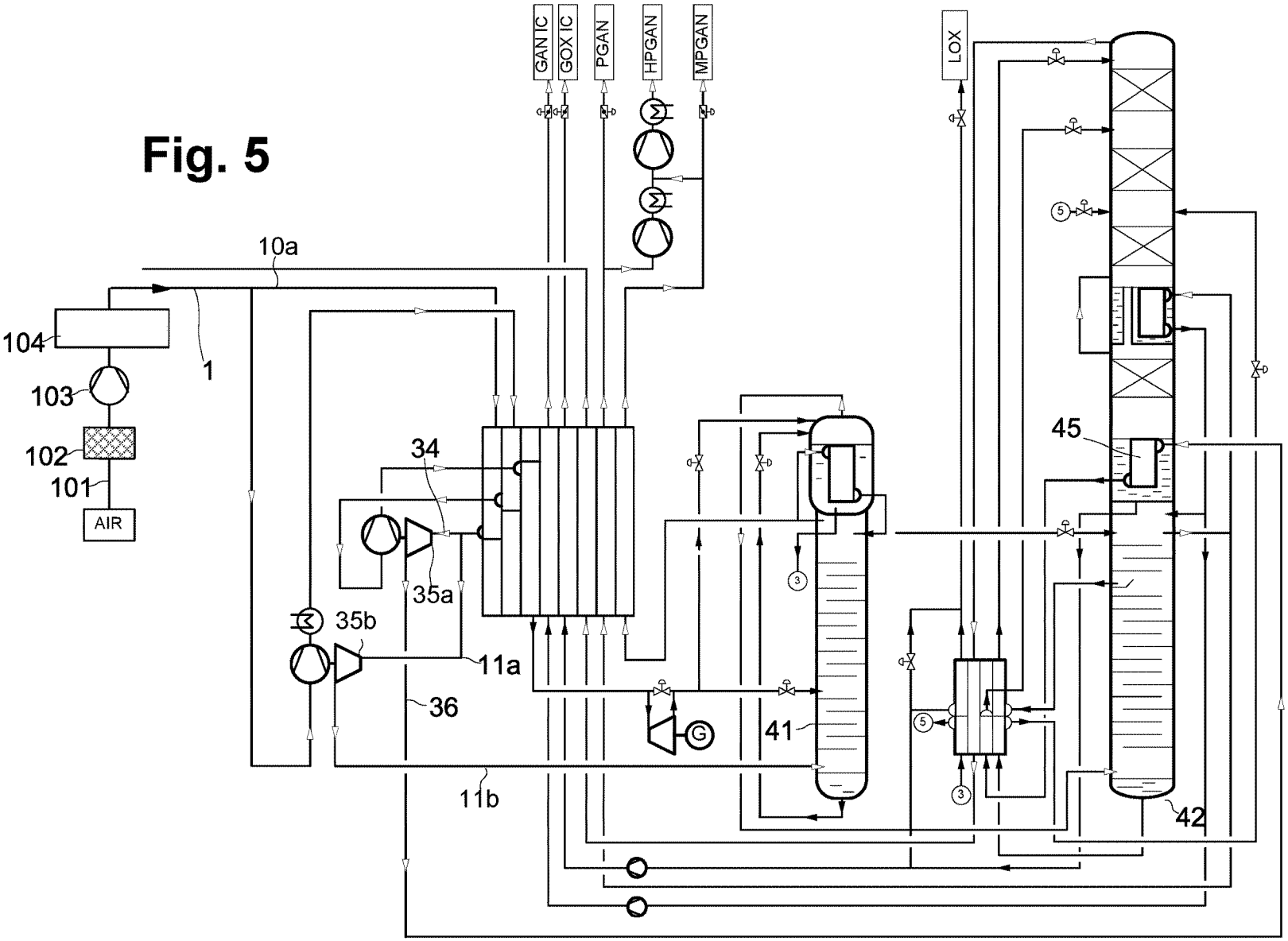

FIG. 5 illustrates an exemplary embodiment in which the material exchange elements in the pre-column 41 and the high-pressure column 42 are formed by sieve bases. In contrast to FIG. 1, this is a high-pressure method (HAP—high air pressure); thus, all the air is compressed to a pressure that is at least 1 bar higher than the highest operating pressure in the distillation column system, which in the exemplary embodiment are approximately 17 bar. For this purpose, the use of post-compressors that are driven by external energy may be dispensed with here.

The exemplary embodiment according to FIG. 5 further differs from FIG. 1 in the use of two gas expansion turbines, a first air turbine 35*a* and a second air turbine 35*b*, In the first air turbine 35*a*, as before the third partial current 34 is let down such that work is performed, and it is then guided to the liquefaction chamber of the low-pressure column sump evaporator 45 by way of line 36. The first partial current 11*a* is sent through the second air turbine 35*b* and, after being let down such that work is performed, is fed into the pre-column 41 entirely or substantially in gaseous form, by way of line 11*b*. In the exemplary embodiment, the two air turbines 35*a*, 35*b* are at the same entry pressure (approximately 17 bar) and the same entry temperature, and for this reason the first and the third partial current are jointly fed to the main heat exchanger by way of line 10*a* and are removed again by way of line 10*b*. As an alternative, the two turbines 35*a*, 35*b* may be at different entry temperatures and where appropriate different entry pressures.

The method according to FIG. 5 is in particular suitable for a supercritical oxygen product pressure (GOX IC) (in the example illustrated, approximately 50 bar), in particular in the case of low compressed nitrogen production (GAN IC) and low liquid production (LOX, where appropriate LIN, if a pure nitrogen section according to FIG. 4 is used). The term "low" here is understood to mean a molar content of the respective products in the entire input air quantity of less than 2 mol %, in particular less than 1 mol %.

The invention claimed is:

1. A method for generating gaseous compressed nitrogen by low-temperature separation of air in a distillation column system having a pre-column which has a pre-column head condenser/evaporator having a liquefaction chamber and an evaporation chamber, a high-pressure column and a low-pressure column, said process comprising:

compressing input air in a main air compressor to form compressed input air, cleaning the compressed input air in a cleaning device to form cleaned input air, cooling the cleaned input air in a main heat exchanger to form cooled input air, feeding a first partial stream of the cooled input air in gaseous form into the pre-column, feeding a second partial stream of the cooled input air in a predominantly liquid state into the distillation column system, feeding a gaseous fraction from an upper region of the pre-column into the liquefaction chamber of the head condenser/evaporator wherein liquid is formed in said liquefaction chamber, and returning at least part of the liquid formed in the liquefaction chamber to the pre-column, wherein said low-pressure column has a low-pressure column sump condenser/evaporator which has a liquefaction chamber and an evaporation chamber, withdrawing a first nitrogen product fraction from the high-pressure column in gaseous form, warming said first nitrogen product fraction in the main heat exchanger, and removing warmed first nitrogen product fraction from the main heat exchanger to form a first gaseous compressed nitrogen product, feeding at least a first substream of the second partial stream into the evaporation chamber of the pre-column head condenser/evaporator, subjecting a third partial stream of the cooled input air to pressure reduction whereby work is performed, wherein, after said pressure reduction, the third partial stream has a pressure which is higher than an operating pressure of the low-pressure column, wherein, after said pressure reduction, the third partial stream is fed into the liquefaction chamber of the low-pressure column sump condenser/evaporator and is at least partly liquefied there to form liquefied third partial stream, feeding at least a substream of the liquefied third partial stream into the low-pressure column, wherein said sub stream of the liquefied third partial stream is liquefied air, wherein the low-pressure column has an intermediate condenser/evaporator having a liquefaction chamber and an evaporation chamber, evaporating at least part of an intermediate liquid of the low-pressure column in the evaporation chamber of the intermediate condenser/evaporator, liquefying at least part of a gaseous head fraction from the high-pressure column in the liquefaction chamber of the intermediate condenser/evaporator to form liquid, and returning at least part of the liquid formed in the liquefaction chamber of the intermediate condenser/evaporator to the high-pressure column, and wherein said first gaseous compressed nitrogen product is more than 35 mol % of said input air.

2. The method as claimed in claim 1, wherein a second gaseous nitrogen product fraction is withdrawn from the pre-column in gaseous form, warmed in the main heat exchanger and removed from the main heat exchanger to form a second gaseous compressed product.

3. The method as claimed in claim 1, wherein less than 30 mol % of said input air is fed in the liquid state into the distillation column system.

4. The method as claimed in claim 1, wherein the quantity of oxygen-enriched streams fed in the liquid state from the pre-column and the evaporation chamber of the pre-column head condenser/evaporator into the high-pressure column and the low-pressure column is less than 14 mol % of said input air.

5. The method as claimed in claim 1, wherein the second partial stream is compressed, before being cooled in the main heat exchanger, to a pressure that is higher than an operating pressure of the pre-column, and is liquefied or pseudo-liquefied in the main heat exchanger, and a liquid stream is removed from the distillation column system, brought to an elevated pressure in the liquid state, evaporated or pseudo-evaporated in the main heat exchanger.

6. The method as claimed in claim 1, wherein a gaseous fraction from the evaporation chamber of the pre-column head condenser/evaporator is fed, in the form of a gaseous input stream, into the high-pressure column.

7. The method as claimed in claim 1, wherein at least some sump liquid of the pre-column is fed into the evaporation chamber of the pre-column head condenser/evaporator.

8. The method as claimed in claim 1, wherein the third partial stream is further compressed before being cooled in the main heat exchanger.

9. The method as claimed in claim 1, wherein, after said reducing, the pressure of the third partial stream is lower than an operating pressure of the high-pressure column.

10. The method as claimed in claim 4, wherein the total quantity of oxygen-enriched streams fed in the liquid state from the pre-column and the evaporation chamber of the pre-column head condenser/evaporator into the high-pressure column and the low-pressure column is less than 1 mol % of said input air.

11. The method as claimed in claim 1, wherein more than 45 mol % of the input air, in the form of the first nitrogen product fraction, is withdrawn in gaseous form from the high-pressure column and warmed in the main heat exchanger.

12. The method as claimed in claim 1, wherein the second partial stream is compressed, before being cooled in the main heat exchanger, to a pressure that is higher than an operating pressure of the pre-column, and is liquefied or pseudo-liquefied in the main heat exchanger, and a liquid oxygen stream is removed from the distillation column system, brought to an elevated pressure in the liquid state, and evaporated or pseudo-evaporated in the main heat exchanger.

13. The method according to claim 1, wherein the pre-column has a head, the low-pressure column has a head, and the high-pressure column has a head, and an operating pressure at the head of the pre-column is 6 to 9 bar, an operating pressure at the head of the high-pressure column is 3 to 6 bar, and an operating pressure at the head of the low-pressure column is 1.25 to 1.7 bar.

14. A method for generating gaseous compressed nitrogen by low-temperature separation of air in a distillation column system having a pre-column which has a pre-column head condenser/evaporator having a liquefaction chamber and an evaporation chamber, a high-pressure column and a low-pressure column, said process comprising:

compressing input air in a main air compressor to form compressed input air, cleaning the compressed input air in a cleaning device to form cleaned input air, cooling the cleaned input air in a main heat exchanger to form cooled input air, feeding a first partial stream of the cooled input air in gaseous form into the pre-column, feeding a second partial stream of the cooled input air in a predominantly liquid state into the distillation column system, feeding a gaseous fraction from an upper region of the pre-column into the liquefaction chamber of the head condenser/evaporator wherein liquid is formed in said liquefaction chamber, and returning at least part of the liquid formed in the liquefaction chamber to the pre-column, wherein said low-pressure column has a low-pressure column sump condenser/evaporator which has a liquefaction chamber and an evaporation chamber, withdrawing a first nitrogen product fraction from the high-pressure column in gaseous form, warming said first nitrogen product fraction in the main heat exchanger, and removing warmed first nitrogen product fraction from the main heat exchanger to form a first gaseous compressed nitrogen product, feeding at least a first substream of the second partial stream into the evaporation chamber of the pre-column head condenser/evaporator, subjecting a third partial stream of the cooled input air to pressure reduction whereby work is performed, wherein, after said pressure reduction, the third partial stream has a pressure which is higher than an operating pressure of the low-pressure column, wherein, after said pressure reduction, the third partial stream is fed into the liquefaction chamber of the low-pressure column sump condenser/evaporator and is at least partly liquefied there to form liquefied third partial stream, feeding at least a substream of the liquefied third partial stream into the low-pressure column, wherein said sub stream of the liquefied third partial stream is liquefied air, wherein the low-pressure column has an intermediate condenser/evaporator having a liquefaction chamber and an evaporation chamber, evaporating at least part of an intermediate liquid of the low-pressure column in the evaporation chamber of the intermediate condenser/evaporator, liquefying at least part of a gaseous head fraction from the high-pressure column in the liquefaction chamber of the intermediate condenser/evaporator to form liquid, and returning at least part of the liquid formed in the liquefaction chamber of the intermediate condenser/evaporator to the high-pressure column, wherein said first gaseous compressed nitrogen product is more than 35 mol % of said input air, and wherein less than 30 mol % of said input air is fed in the liquid state into the distillation column system.

15. A method for generating gaseous compressed nitrogen by low-temperature separation of air in a distillation column system having a pre-column which has a pre-column head condenser/evaporator having a liquefaction chamber and an evaporation chamber, a high-pressure column and a low-pressure column, said process comprising:

compressing input air in a main air compressor to form compressed input air, cleaning the compressed input air in a cleaning device to form cleaned input air, cooling the cleaned input air in a main heat exchanger to form cooled input air, feeding a first partial stream of the cooled input air in gaseous form into the pre-column, feeding a second partial stream of the cooled input air in a predominantly liquid state into the distillation column system, feeding a gaseous fraction from an upper region of the pre-column into the liquefaction chamber of the head condenser/evaporator wherein liquid is formed in said liquefaction chamber, and returning at least part of the liquid formed in the liquefaction chamber to the pre-column, wherein said low-pressure column has a low-pressure column sump condenser/evaporator which has a liquefaction chamber and an evaporation chamber, withdrawing a first nitrogen product fraction from the high-pressure column in gaseous form, warming said first nitrogen product fraction in the main heat exchanger, and removing warmed first nitrogen product fraction from the main heat exchanger to form a first gaseous compressed nitrogen product, feeding at least a first substream of the second partial stream into the evaporation chamber of the pre-column head condenser/evaporator, subjecting a third partial stream of the cooled input air to pressure reduction whereby work is performed, wherein, after said pressure reduction, the third partial stream has a pressure which is higher than an operating pressure of the low-pressure column, wherein, after said pressure reduction, the third partial stream is fed into the liquefaction chamber of the low-pressure column sump condenser/evaporator and is at least partly liquefied there to form liquefied third partial stream, feeding at least a substream of the liquefied third partial stream into the low-pressure column, wherein said sub stream of the liquefied third partial stream is liquefied air, wherein the low-pressure column has an intermediate condenser/evaporator having a liquefaction chamber and an evaporation chamber, evaporating at least part of an intermediate liquid of the low-pressure column in the evaporation chamber of the intermediate condenser/evaporator, liquefying at least part of a gaseous head fraction from the high-pressure column in the liquefaction chamber of the intermediate condenser/evaporator to form liquid, and returning at least part of the liquid formed in the liquefaction chamber of the intermediate condenser/evaporator to the high-pressure column, wherein said first gaseous compressed nitrogen product is more than 35 mol % of said input air, and wherein, after said reducing, the pressure of the third partial stream is lower than an operating pressure of the high-pressure column.

16. The method as claimed in claim 1, further comprising splitting said second partial stream of the cooled input air, before being introduced into the distillation column system, into said first substream of the second partial stream and a second substream of the second partial stream, and feeding said second substream of the second partial stream into the pre-column.

17. The method as claimed in claim 1, further comprising removing a liquid flushing stream from the evaporation chamber of the pre-column head condenser/evaporator, warming the liquid flushing stream in a heat exchanger, and then feeding the flushing stream into the low-pressure column.

* * * * *